US005727689A

United States Patent [19]

Anderson et al.

[11] Patent Number: 5,727,689

[45] Date of Patent: Mar. 17, 1998

[54] TREATMENT DEVICE FOR PARTICULATE MATERIALS

[75] Inventors: George E. Anderson, Champlin; William L. Kratochwill, Minneapolis; Darcy Moses, Rush City; William L. Stevenson, Roseville; Joe C. Givens, Minneapolis, all of Minn.

[73] Assignee: Crown Iron Works Company, Minneapolis, Minn.

[21] Appl. No.: 638,340

[22] Filed: Apr. 26, 1996

Related U.S. Application Data

[63] Continuation of Ser. No. 382,148, Feb. 1, 1995, abandoned, which is a continuation of Ser. No. 245,418, May 18, 1994, abandoned, which is a continuation of Ser. No. 883,140, May 14, 1992, abandoned, which is a continuation of Ser. No. 755,318, Sep. 5, 1991, abandoned, which is a continuation of Ser. No. 621,805, Dec. 4, 1990, abandoned, which is a continuation of Ser. No. 185,139, Apr. 22, 1988, abandoned.

[51] Int. Cl.[6] ..... B07B 7/00

[52] U.S. Cl. ..... 209/139.1

[58] Field of Search ..... 99/570, 571, 612, 99/613; 209/11, 132, 133, 138, 139.1, 143, 145, 149, 154, 147; 241/7–9, 11–13, 40, 43, 44, 48, 49, 52, 57, 60, 61, 65, 66, 76, 79.1, 97, 274

[56] References Cited

U.S. PATENT DOCUMENTS

| | | |
|---|---|---|
| 788,741 | 5/1905 | Trump . |
| 793,450 | 6/1905 | Leonard . |
| 1,861,248 | 5/1932 | Stebbins . |
| 2,214,434 | 9/1940 | Nelms . |
| 2,579,228 | 12/1951 | Erickson . |
| 2,620,841 | 12/1952 | Jacobson . |
| 2,975,898 | 3/1961 | Nelson . |
| 3,111,483 | 11/1963 | Kibsgaard . |
| 3,925,198 | 12/1975 | Eckhoff et al. . |
| 4,059,231 | 11/1977 | Neu . |
| 4,299,694 | 11/1981 | Goodell . |

FOREIGN PATENT DOCUMENTS

| | | |
|---|---|---|
| 1107351 | 9/1954 | France . |
| 0024362 | 2/1979 | Japan . |
| 939135 | 7/1982 | Russian Federation . |
| 312852 | 6/1929 | United Kingdom . |

*Primary Examiner*—D. Glenn Dayoan

*Attorney, Agent, or Firm*—Nawrocki, Rooney & Sivertson, P.A.

[57] ABSTRACT

A device for conditioning particulate matter such as particalized soybean meats and hulls. The device includes a chamber. The chamber includes a lower increased velocity stage in which gas movement is accelerated because of constriction resulting from the interposition of a plurality of staves. The lower increased velocity stage is disposed beneath a normal velocity stage which is coextensive with a discontinuity in a side wall of the chamber through which particulate matter is introduced. Gas flow is introduced into the chamber proximate the bottom end thereof and is directed upwardly in a direction opposite that in which particulate matter passes downwardly under the influence of gravity. The velocity of the gas through the normal velocity stage is regulated so that heavier particulate materials will pass downwardly and lighter materials will pass upwardly. Velocity is maintained at a level through the lower increased velocity stage so that downward passage of the heavier particulate materials will still be permitted. As those materials pass downwardly, grains would ricochet off the various staves in order to facilitate further separation in an application wherein the particulate materials comprise fragments, for example, of soybean meats and hulls.

3 Claims, 3 Drawing Sheets

TREATMENT DEVICE FOR PARTICULATE MATERIALS

This is a continuation of Application Ser. No. 08/382,148 filed on Feb. 1, 1995 now abandoned, which is a continuation of application Ser. No. 08/245,418 filed on May 18, 1994, now abandoned, which is a continuation of application Ser. No. 07/883,140 filed on May 14, 1992, now abandoned, which is a continuation of application Ser. No. 07/755,318 filed on Sep. 5, 1991, now abandoned, which is a continuation of application Ser. No. 07/621,805 filed on Dec. 4, 1990, now abandoned, which is a continuation of application Ser. No. 07/185,139 filed on Apr. 22, 1988, now abandoned.

TECHNICAL FIELD

The present invention deals broadly with the treatment of particulate materials such as, but not limited to, oil seeds, grains, or other granular solids. With some of the organic products itemized above, they are also processed to separate the meat, or center portion, of the solids from the hull, or encasing portion. More narrowly, however, the present invention deals with the heat treatment or conditioning of soybeans and other oil seeds to facilitate the dehulling and flaking thereof. The preferred embodiment of the invention comprises apparatus for treating the material by the application of both moisture and heat to bring it to a condition at which separation of the hull from the meat is easily and economically accomplished and the meat is plasticized sufficiently for flaking.

BACKGROUND OF THE INVENTION

Treatment of various particulate materials is performed in order to render the material so that it has particularly desired characteristics. For example, where fragments of two materials are interspersed among each other, it is often necessary to separate tile different types of fragments. A corollary to this separating function is a situation wherein it is necessary to clean fines of one material from particles of another.

In the case of certain particulate solids, it is necessary to process the material by effecting preheating, heating, cooling, drying, or moisturizing. Additionally, some materials require that they be roasted, sterilized, or debittered. The performance of these functions is frequently applicable when the material being processed is a grain.

Additionally, the processing of various grains often involves the separation of the hull, or outer encasement, from the meat so that the meat can be employed in further utilization. For example, in the case of soybeans, it is generally desireable to separate the meats from the hulls prior to recovering oil from the meats.

In the case of soybeans, a constant evolution and improvement in methods employed for separation of the hulls from the meats is ongoing. Strong interest in effecting such improvement has arisen in recent years because of the necessity of reducing costs in the soybean processing industry. These costs include, among others, the costs of investment, labor, energy, and manufacturing overhead.

The various prior art attempts to improve conditioning processes, while better than previous processes, fall short of solving all of the problems extant in this technology. Certainly, apparatus which would enable effective and economic processing of an oil seed such as soybeans and yet involve few steps would be a significant advance. For example, apparatus which would obviate the need for predrying and tempering of the grain would go far to reduce the cost of processing of oil seeds and other grains by eliminating the need to heat and cool the oil seed a plurality of times. Additionally it would be desirable to effect efficient hull removal concurrent with the conditioning process.

Various solutions of the prior art accomplish some of these desired goals. None, however, accomplishes each and every goal and provides each desirable feature dictated by the prior art. For example, one proposed solution eliminates the predrying and tempering steps, but involves excessive investment cost and use of electric power. In addition, it requires separate systems for conditioning and hull removal.

Another proposed solution is intended to improve the quality of oil recovered when conditioning and dehulling is accomplished in accordance with the process. The proposed solution, however, produces meal of lower quality than would be desired due to the excessive moisture, temperature, and time used. Further, this solution uses more energy and requires more costly equipment.

It is to these problems and desirable features dictated by the prior art that the present invention is directed. It is an apparatus which improves over all known devices, and methods employing those devices, as known in the prior art.

SUMMARY OF THE INVENTION

The present invention is a device for conditioning particulate matter. It includes a conditioning chamber which has a discharge proximate one end thereof. An inlet is spaced axially from the discharge. Means, intermediate the inlet and discharge are provided for redirecting and disbursing passage of the particulate matter as it passes through the chamber from the inlet to the discharge thereof. Means are provided for depositing unconditioned particular matter into the chamber through the inlet. Means are also provided for conveying conditioned particulate matter, having been processed as it passed through the chamber, away from the chamber discharge.

In a preferred embodiment of the invention, means are provided for generating a gas flow and for channeling the gas flow into a lower portion of the chamber. After introduction into the chamber, the gas flow passes upwardly therethrough.

The preferred embodiment envisioned a discharge proximate the lower end of the chamber and an inlet which is spaced upwardly from the discharge. Preferrably, the inlet is proximate the upper end of the chamber.

In one embodiment of the invention, means can be provided for heating the gas flow prior to its introduction and channeling into the lower portion of the chamber. Such an embodiment would, typically, be employed in an application wherein the particulate matter is a grain such as an oil seed that is to be heated as it passes downwardly through the chamber after having been introduced therein at an upper end of the chamber.

The invention can further include an embodiment for separating fragments of, for example, the hulls of an oil seed from the meats thereof. In such an embodiment, the inlet could take the form of a discontinuity at a location along a lateral wall of the chamber. Interspersed fragments of the particulate meats and hull materials would be introduced into the chamber through the inlet.

The gas flow introduced into the chamber proximate the bottom end thereof is directed upwardly in a direction opposite that in which the meats pass while under the influence of gravity. Since the meats have a greater terminal velocity than do the hull fragments, the velocity can be varied so that the meats will be allowed to pass downwardly even through an increased velocity stage having a plurality of staves therein which extend across the chamber in an area between the gas ingress port and the discontinuity in the side wall through which the particulate matter is introduced into the chamber. The velocity can be regulated so that it is sufficiently great wherein hull particles will be caused to move upwardly under the influence of the gas flow.

The staves can be disposed at spacings across the increased velocity stage so that gas flow, as it passes through that stage, will be increased sufficiently so that a minimum amount of hull particles will be able to pass downwardly. The staves can be dispersed so that there is not a continuous path downwardly along which meats particles can traverse without engaging one or more of the staves. Hull particles adhering to meats particles will, therefore, tend to be dislodged as the meats collide with the staves during their downward traverse.

In this application, all upper increased velocity stage, above an unconstricted stage coextensive with the discontinuity in the side wall, can be provided. Such an upper increased velocity stage would, typically, include a second plurality of staves extending across the chamber in an area between the discontinuity and the gas egress port proximate the upper end of the chamber. The upper increased velocity stage functions, among other purposes, to accelerate the hull particles already passing upwardly.

The staves in both the upper and lower increased velocity stages define, therebetween, multiplicities of downwardly extending tortuous paths along which particulate materials pass. That is, the staves are arranged so that the particulate materials cannot directly pass through the stages of the chamber. Rather they will strike one or more staves and bounce randomly, from side to side, as they pass upwardly under the influence of the gas flow or downwardly under the influence of gravity.

A preferred embodiment of the conditioner device envisions employment of a plurality of modules to aggregately comprise the chamber. Each module, in order to accomplish a measure of universality, can be similarly configured to other modules. Each module would, therefore, have, passing therethrough, a plurality of staves.

The staves, it is envisioned, would each take the form of a duct made of tubing. The tubing would have an internal passage. The passages of the staves ducts would be isolated from the interior of the conditioning chamber. Heated gas, hot liquid, or a condensible gas (for example, steam) could be directed through these ducts to effect heating of the staves and thereby further heating of materials and gas passing through the chamber. Since there is no direct communication between the heating medium passing through the ducts and the interior of the conditioning chamber, heating thereby effected is known as "indirect heating".

The preferred embodiment of the invention further envisions employment of means for returning a mixture of air and steam in any proportion (that is, the gas passing upwardly through the conditioning chamber) to the means by which flow generation is created. Typically, such means would comprise appropriate conduits for returning the gas to a blower and heater for regeneration.

As will be able to be seen in view of this disclosure, a system in accordance with the present invention can, therefore, be a closed system. That is, the system, with the exception of tile ducts passing through the conditioning chamber, can be substantially closed to the environment of the conditioning equipment. It will be understood, however, that additional air or steam can be provided through an appropriate valve, and means for bleeding excess air or steam can be incorporated.

Further, the conditioning apparatus in accordance with the present invention can include means for removing fine particulate matter Which becomes entrained in the gas flow exiting from the conditioning chamber. It is envisioned that such means could include one or more cyclone separators interspersed into the conduiting interconnecting the condition chamber and the blower and heater.

The present invention is thus an improved device for conditioning particulate materials. The conditioner is improved in numerous respects Over apparatus known in the prior art. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
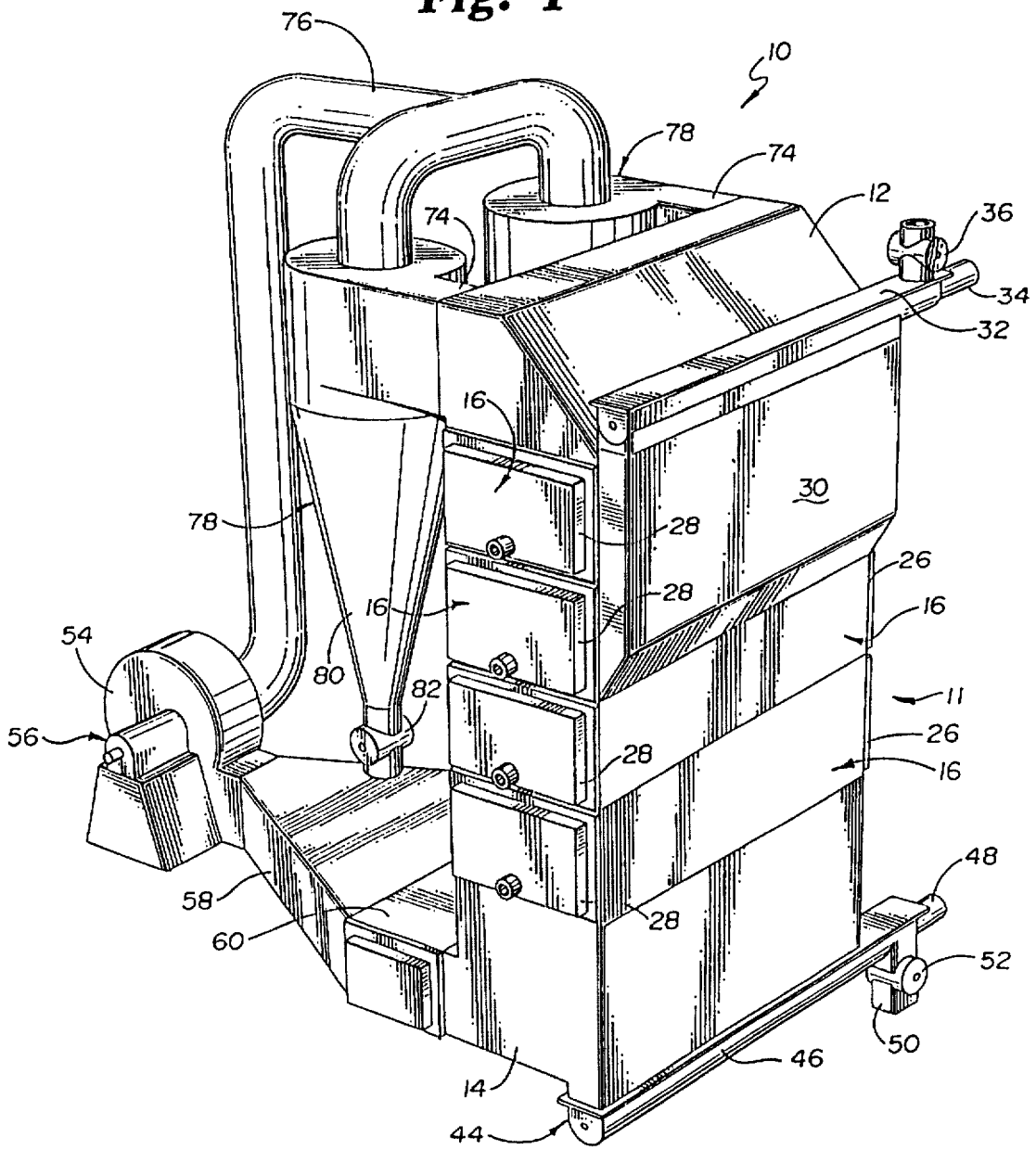
FIG. 1 is a perspective view of a conditioning apparatus in accordance with the present invention.

Referring now to the drawings wherein like reference numerals denote like elements throughout the several views, FIG. 1 illustrates a conditioner 10 in accordance with the present invention. That figure illustrates a generally vertically disposed conditioning chamber 11. While the chamber 10 can take the form of an integrated, unitary structure, the preferred embodiment is shown as including a substantially fixed upper portion 12 and a substantially fixed lower portion 14. These portions 12, 14 are in fluid communication with other structure of the device 10. The structures with which those upper and lower portions 12, 14 are in fluid communication will be discussed more specifically hereinafter.

A plurality of conditioning modules 16 can be interposed between the upper and lower portions 12, 14 of the conditioning chamber 11. It is envisioned that each module 16 would be substantially the same in construction as would every other module 16.

Figure 2:
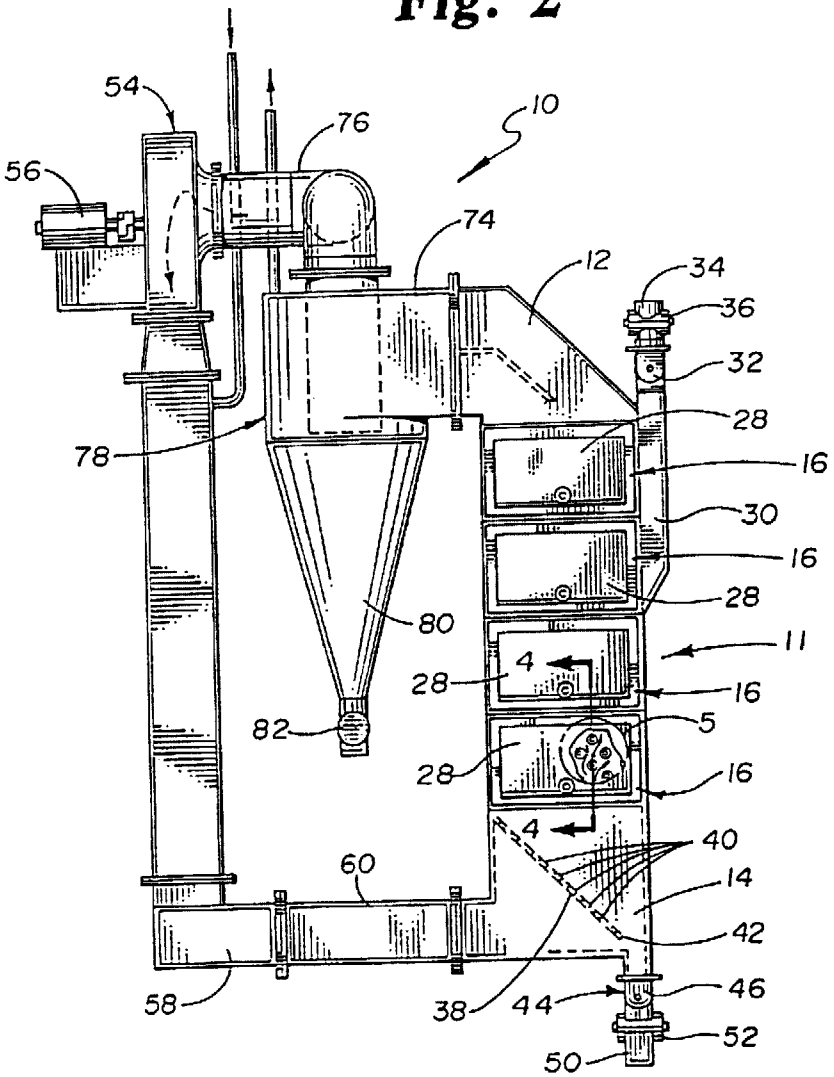
FIG. 2 is a side elevational, schematic view of a conditioner such as that illustrated in FIG. 1.
Figure 5:
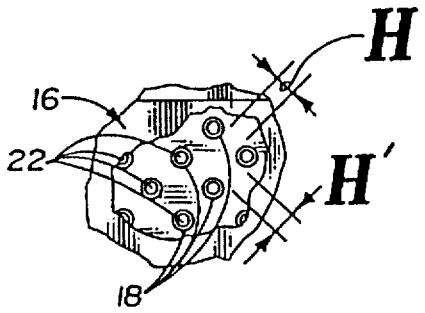
FIG. 5 is an enlarged fragmentary view of the area encircled at 5 in FIG. 2.
Figure 4:
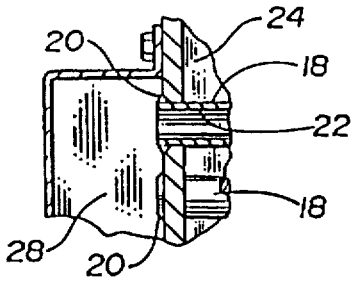
FIG. 4 is an enlarged fragmentary cross-sectional view taken generally along 4—4 of FIG. 2.
Figure 6:
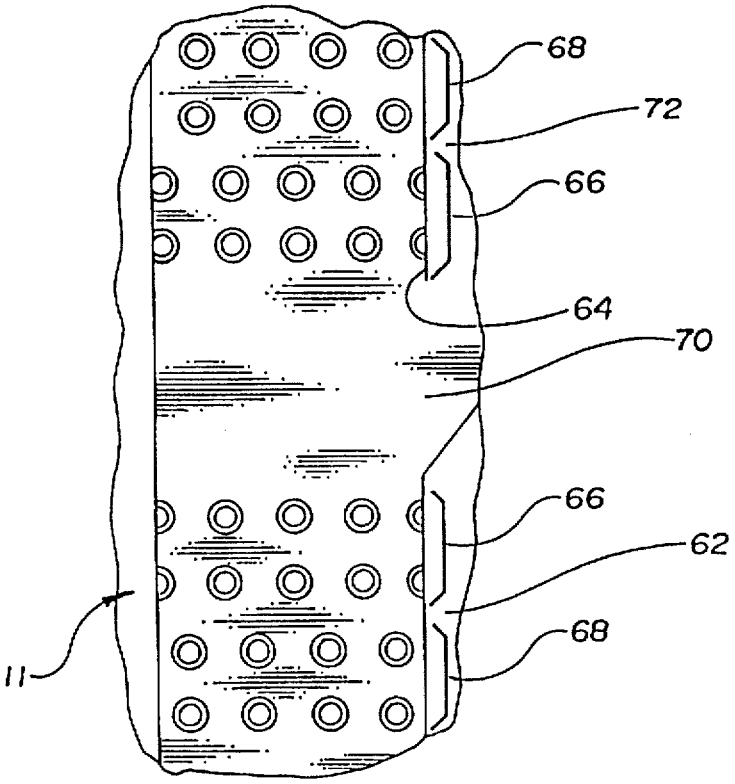
FIG. 6 is a view, similar to FIG. 5, illustrating another tube or conduit pattern.

FIG. 2 illustrates a conditioning equipment 10 in accordance with the invention in schematic portrayal. Some structural representation of the specifics of a module 16 is shown in that figure. FIGS. 4, 5, and 6, however, illustrate specifics of module construction in more detail.

Referring then to FIGS. 4 and 5, in combination with FIGS. 1 and 2, it can be seen that each module 16, in its preferred construction, has a plurality of staves 18, which can take the form of ducts, extending therethrough. The staves 18, or ducts, extend completely through the portion of the chamber 11 defined by the particular module 16, and ends of the ducts are sealed at left and right side walls of the module as at 20. They are maintained, therefore, so that the passages 22 through the ducts 18 are isolated from the interior 24 of the respective module 16 defining a portion of the conditioning chamber 11.

Each module 16 is shown as including an inlet and an outlet manifold 26, 28. Steam, for example, can be introduced into an inlet manifold 26 of each of the modules 16 employed and be distributed through the plurality of ducts 18 associated with a particular module inlet manifold 26.

Steam is directed through the ducts 18. The steam (when steam is the fluid employed) partially or wholly condenses in the duets and the remaining steam and condensate is directed out of manifold 28.

As best seen in FIG. 5 the ducts 18 in one particular module 16 are arranged with desired spacings so as to maximize the heating effect of the steam passing through the ducts 18 in the conditioning chamber 11 and to define sinuous paths down which a particulate material such as raw oil seed introduced into the chamber 11 passes. The spacing of the ducts 18 illustrated in FIG. 5 in one diagonal direction is identified as H, and the spacing of the ducts 18 in the other diagonal direction is identified as H'. H and H' are made sufficiently small so that a matrix is formed wherein particulate material introduced into the chamber 11 in the upper portion thereof will be unable to pass directly downwardly through the chamber 11 without engaging various of the ducts 18 and ricocheting from duct to duct as it is influenced by gravity. The ricocheting thereby accomplished has the effect both of slowing passage of, for example, oil seed kernels downwardly through the chamber 11 and of loosening the hulls of the oil seed.

The disposition of staves also serves, according to rules governing statistical distribution, to promote uniform distribution of the granular solid particles across the flow area as they traverse the column length, and serves, according to the principles of fluid flow through multiple, equal-sized orifices, to promote uniform distribution of the gas in contact with the particles. The staves, therefore, act to promote efficient contact of the particles with the gas, adding to the efficiency of the process and uniformity of the product.

Other means of obtaining sufficient time and adequate distribution to promote proper conditioning, such as a column with increased length or an arrangement of baffles, can be used. The use of staves is only a preferred embodiment.

Further, as previously indicated, heat from the steam passing through or condensing in the ducts 18 will heat the chamber 11 for a purpose as will be discussed hereinafter.

Particulate material is introduced in an upper portion of the conditioning chamber 11. This is facilitated by employment of an oil seed inlet manifold 30. The manifold 30 can be made to communicate with one or more of upwardly disposed modules 16, the manifold 30, thereby, affording means for introducing the particulate material into the chamber 11 at a desired vertical location.

An upper portion of the manifold 30 is provided with a screw conveyor 32. The conveyor 32 is driven by a motor 34, and it functions to laterally distribute the particulate material introduced into the manifold 30 through a raw product inlet. FIG. 1 shows this inlet as a generally vertically extending pipe. Means, such as a rotary valve 36, can be employed for regulating flow of the raw product into the portion of the manifold 30 occupied by the screw conveyor 32.

The lower portion of the conditioning chamber 11 may be provided, as best seen in FIG. 2, with a diagonally disposed, porous plate 38. The plate 38 is provided with perforations 40 which are of a size so as to preclude the downward passage of particulate matter having passed downwardly through the conditioning chamber 11. The lower edge 42 of the plate 38 is, therefore, laterally disposed so that the matter having passed downwardly through the chamber 11 can be deposited into a trough 44 occupied by a second screw conveyor 46. This second screw conveyor 46 is driven by a motor 48 Which transfers the conditioned material to a discharge pipe 50. As in the case of the raw product inlet, the discharge pipe 50 can be provided with movement control means, such as a rotary valve 52, for controlling product egress from the conditioning chamber 11 and precluding entry of ambient air into the system.

As previously indicated, the diagonally disposed plate 38 in the bottom portion of the conditioning chamber 11 is provided with perforations 40 small enough to preclude passage through of the bulk of the material having passed downwardly through the chamber 11. Conversely, however, the apertures 40 afford passage therethrough of a heated gas. A gas, such as an air-steam mixture, is introduced into the bottom portion of the chamber 11 and allowed to rise within the chamber 11, in one embodiment, in a counter-current relationship to the solid product passing downwardly. This gas is called the "conditioning gas," because it passes through the same plenum as does the material which it is intended to condition and is not segregated therefrom by any baffle, wall, or other structure.

The steam, when steam is used for heating the ducts 18 passing through the various modules 16, is known as "indirect steam". This is because it never directly mingles with the product it is intended to condition. That is, it is always segregated from that product, as the product passes downwardly through the conditioning chamber 11, by the annular walls of the respective ducts 18 through which it passes.

For the purposes of description of a particular application of the device 10, it will be assumed that the gas employed for direct conditioning is a mixture of air and steam and that the particulate material being conditioned is an oil seed such as soybeans. Flow of the gas is generated by a blower 54 actuated by a variable speed motor 56. Flow velocity can, thereby, be selectively controlled.

The flow generated by the blower 54 passes through a duct 58 to a heat exchanger 60. In the heat exchanger 60, the gas can be treated to provide it with an appropriate level of moisture and temperature. It will be understood that other heaters (not shown) can be employed to have previously brought the gas to at least approximately a desired temperature. The heat exchanger 60 functions to provide it with as precise as possible a temperature prior to its entering the conditioning chamber 11.

The gas passes upwardly through the chamber 11 counter-current, in one embodiment, to the downwardly passing raw product. Treatment of the raw product is effected in a number of fashions. The gas entering the chamber 11 can be heated so that it will both dry the oil seed and extremely rapidly bring it to a high temperature. As heat exchange from the gas to the oil seed occurs, moisture in the oil seed will be transferred to the gas. If the gas being used is a mixture including superheated steam, as it passes upwardly in the chamber 11 and loses its superheat, contact with cool incoming raw product can be used to effect a hydration of the oil seed in upper portions of the chamber 11 due to condensation of the steam component of the gas. This drying and/or moisturization can be regulated by adjustment of the temperature of the heat exchanger 60 and staves 18, and adjustment of the ratio of steam to air in the conditioning gas.

The particular application of the device 10 wherein an air/steam mixture is employed for conditioning oil seed such as soybeans can employ a chamber 11 wherein the chamber modules 16, collectively, define a lower portion of the chamber 11 wherein velocity of the gas is increased above an initial velocity at which it is introduced into the chamber 11. This increased velocity occurs as a result of the constriction of the area through which the gas passes upwardly. This constriction is effected as a result of the interposition of the staves or ducts 18, although other means to effect a restriction may be used as well (for example, baffles, wall undulations, or other structures).

FIG. 6 illustrates a particular stave or duct arrangement that is advantageously employed in an application for dehulling soybeans and separating the hulls from the meats. A section 62 in which increased velocity is accomplished because of the interposition of the staves 18 extends between the lower end of the chamber 11 and a point below a discontinuity 64 in the side wall of chamber 11, communicating with manifold 30, through which the soybean product is introduced.

The particular stave arrangement illustrated is one wherein two identical rows 66 of equally spaced staves 18 are alternated with two similar rows 68 of, again, equally spaced staves 18, but wherein the second two rows 68 are offset from the first two rows 66. Such an arrangement is one that enhances engagement of the staves 18 by the soybean meats as they pass downwardly through the stage 62. This arrangement of staves is one of several arrangements which have been found to have similar advantages.

It is envisioned that the cross-sectional area, on center through a row of staves 18, through Which flow passes will be substantially the same as the cross-sectional area, on center through another row of staves 18. Irregular fluid flow patterns can, thereby, be avoided.

A stage 70 of the chamber 11, coextensive with the discontinuity 64 in he side wall through which the oil seed materials are introduced, is unconstricted by any staves. Consequently, the flow velocity through that stage 70 is substantially at the initial velocity at which gas is introduced into the bottom of the chamber 11.

When the soybeans introduced into the chamber 11 are pre-cracked to loosen and remove hulls from the meats prior to introduction into the chamber 11, meats will pass downwardly into the stave constricted stage 62 below the point of introduction in view of regulation of the velocity to a point at which the flow velocity through the constricted stage 62 is slightly below the terminal velocity of the meats. The hulls which have already been removed will pass upwardly because of their lower terminal velocity.

The increased flow rate through the stave constricted stage 62 will retard downward movement through that stage 62. As the meats having hulls still adhered thereto pass downwardly, they will engage and bounce off the various staves 18. The hull particles adhering to those meats will, thereby be separated. Once separated, those hull portions will pass upwardly into and upwardly beyond the non-constricted, initial velocity stage 70 coextensive with the introduction discontinuity 64 in the side wall.

If desired, an upper constricted stage 72 can be provided above the location of the introduction discontinuity 64. Stave spacing in this stage 72, it is envisioned, would be substantially the same as that in the lower increased velocity stage 62. While the velocity would be adjusted so that the initial velocity is sufficient to blow the hull portions upwardly, once they would enter this second increased velocity stage 72, they would be quickly transported upwardly for collection and subsequent disposition.

Throughout passage upwardly through the conditioning chamber 11, the gas will function to retard the downward movement of tile oil seed meats through the chamber 11. Consequently, the oil seed meats will be exposed to the conditioning process for a longer period of time.

It is envisioned that an operator of the device 10 would be able to adjust the velocity of the gas through the conditioning chamber 11 by varying the speed of the motor 56 for driving the blower or the use of dampers. Consequently, the final conditioning of the raw product being processed can be changed depending upon various factors and the desired characteristics of the final product. Factors which would bear upon the flow velocity selected would be the temperature to which the gas is heated, the number of modules 16 employed, terminal velocity of the meats, etc.

Gas arriving at the upper portion of the conditioning chamber 11 is allowed to pass through one or more discharge conduits 74. If more than one discharge conduit 74 is provided, they can be merged into a common conduit 76 for return of the gas to, and treatment by, heaters, the blower 54, and the conditioner 60.

Each discharge conduit 74, however, is provided with a separator for removing fines entrained in the gas as it exits the conditioning chamber. FIGS. 1 and 2 illustrate cyclone separators 78 for effecting this function. Such a separator 78 can be of a typical construction and have a generally conical lower wall 80 for accumulation of the separated fines. A lower extremity of the conical wall can be provided with means, such as a rotary valve 82, for passing the fines to, for example, a conveyor (not shown) by which the fines would be transferred to a location for further processing.

Figure 3:
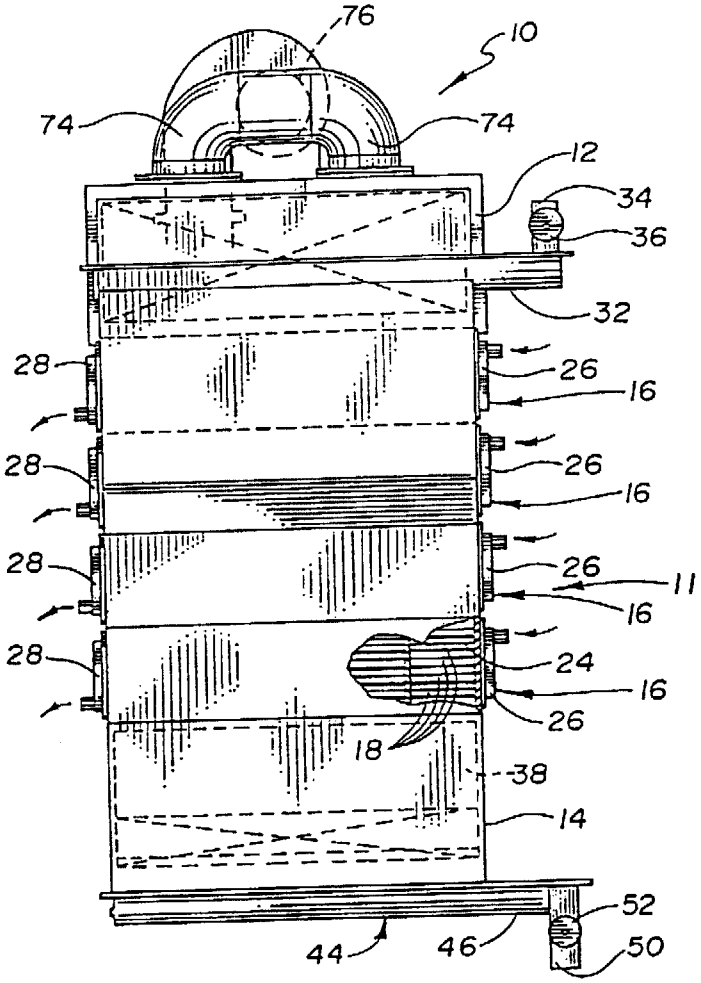
FIG. 3 is a front elevational view of a conditioner as shown in FIG. 2, some portions thereof being broken away.

FIGS. 2 and 3 illustrate the blower 54 at an alternative location. That is, the blower 54 and its driving motor 56 are illustrated as being disposed at a location elevated relative to the bottom portion of the conditioning chamber 11. It will be understood, however, that various dispositions for the blower 54 and its motor 56 can be employed.

It is the intent of the immediately previously discussed application of the present invention to effect rapid heating of, for example, soybeans, being processed by the apparatus, to a temperature of about 170° F. It has been found that kernels elevated to such a temperature can be efficiently processed by appropriate devices such as roll mills, hammer mills, flaking mills, etc. to further process the oil seed. Such equipments are known in the art and, therfore, are merely briefly discussed while not being illustrated in the drawing figures. It will be understood that the product at the discharge 50, after having been conditioned by the device 10, will be conveyed by appropriate means to such further processes.

It has been found, in the processing of soybeans, for example, that employment of a mixture of steam and air at a temperature of from 215° to 420° F. will serve to effect conditioning by adjusting the moisture and raising it to a temperature of 170° F.

Because of the advantages of the structure discussed to this point, it is not necessary to reheat the conditioned oil seed a second time. Consequently, the present invention accomplishes maximum efficiency of conditioning with a minimum of sophistication.

As will be able to be garnered, in view of this disclosure, the present invention has numerous applications in addition to those specifically described. For example, while the primary application described has been one wherein it is used for cleaning and separation of particulate materials, it can also be used to effect heating or cooling, and drying or moisturizing of materials. These functions can be effected upon materials even when no separation of one material from another or cleaning is performed. When the material being processed is a material such as canola, therefore, various characteristics can be conditioned even absent the need for cleaning or separation of particulate materials.

Numerous characteristics and advantages of the invention covered by this document have been set forth in the foregoing description, it will be understood, however, that this disclosure is, in many respects, only illustrative. Changes may be made in details, particularly in matters of shape, size, and arrangement of parts without exceeding the scope of the invention. The inventions scope is, of course, defined in the language in which the appended claims are expressed.

What is claimed is:

1. Apparatus for conditioning an oil seed having, in its natural state, a meat portion encased by a hull, comprising:

(a) a conditioning chamber having a discharge, proximate a lower end of said chamber, an inlet, spaced upwardly from said discharge, and means for redirecting gravity passage of the oil seed as it falls through said chamber from said inlet to said discharge;

(b) means for depositing unconditioned oil seed into said chamber through said inlet thereof;

(c) means for conveying conditioned oil seed away from said conditioning chamber discharge;

(d) means for generating a heated gas flow;

(e) means for channeling said gas flow into a lower portion of said chamber and upwardly therethrough counter-current to the gravity passage of the oil seed downwardly through said chamber, wherein the heated gas flow dries and rapidly heats the oil seed to facilitate removal of the hulls from the meat portions;

(f) means for regulating flow velocity of the gas upwardly through said chamber;

(g) means for returning said gas flow from an upper portion of said chamber to said flow generating means; and (h) a cyclone separator in said returning means, for removing fines entrained in said gas flow departing from said chamber;

(i) whereby gas flow retards downward gravity passage of the oil seed through said chamber.

2. Apparatus for conditioning an oil seed having, in its natural state, a meat portion encased by a hull, comprising:

(a) a conditioning chamber having a discharge, proximate a lower end of said chamber, an inlet, spaced upwardly from said discharge, a multiplicity of generally horizontally-disposed staves passing through an interior of said chamber and arranged to define a multiplicity of tortuous, downwardly-extending paths oil seed passing downwardly through said chamber traverses, each of said staves comprising a duct, an internal passage of which is isolated from communication with said interior of said chamber, and further comprising means for directing a heating fluid through said internal passages;

(b) means for depositing unconditioned oil seed into said chamber through said inlet thereof;

(c) means for conveying conditioned oil seed away from said conditioning chamber discharge;

(d) means for generating a heated gas flow;

(e) means for channeling said gas flow into a lower portion of said chamber and upwardly therethrough counter-current to the gravity passage of the oil seed downwardly through said chamber, wherein the heated gas flow dries and rapidly heats the oil seed to facilitate removal of the hulls from the meat portions; and (f) means for regulating flow velocity of the gas upwardly through said chamber;

(g) whereby gas flow retards downward gravity passage of the oil seed through said chamber.

3. Apparatus in accordance with claim 2, wherein said chamber comprises a plurality of similarly-configured modules, each of said modules including a plurality of said ducts.

* * * * *